United States Patent [19]

Strousser

[11] 3,998,246

[45] Dec. 21, 1976

[54] MEANS FOR KEEPING TRACK IN WEAVING OPERATIONS

[76] Inventor: Penelope Strousser, 4532 Gibson, St. Louis, Mo. 63110

[22] Filed: Feb. 24, 1975

[21] Appl. No.: 552,721

[52] U.S. Cl. ..... 139/1 R; 139/29; 139/317; 35/15; 35/35 A; 235/123

[51] Int. Cl.[2] ..... D03D 29/00; D03J 1/10; G09B 19/20; G09C 1/00

[58] Field of Search ..... 139/1 R, 1 D, 29–33, 139/317, 333–335; 66/1 R, 1 A, 4; 35/15, 35 A, 38, 33; 116/114 R, 114 G, 135, 136; 235/123, 124

[56] References Cited

UNITED STATES PATENTS

| | | | |
|---|---|---|---|
| 61,531 | 1/1867 | Freetsha | 35/15 X |
| 457,166 | 8/1891 | Olsson | 66/1 A |
| 532,110 | 1/1895 | Stockmann | 35/15 |
| 573,813 | 12/1896 | Cleary | 139/335 |
| 645,562 | 3/1900 | Hardwick | 139/317 |
| 1,028,935 | 6/1912 | Deming | 235/123 |
| 1,731,503 | 10/1929 | Petig | 139/317 |
| 1,888,908 | 11/1932 | Connell | 139/33 |
| 1,907,460 | 5/1933 | Strohacker | 139/33 |
| 2,149,724 | 3/1939 | Brooks | 139/33 |
| 2,495,054 | 1/1950 | Cooper | 139/1 R |
| 2,582,319 | 1/1952 | Ellis, Jr. | 66/1 A |
| 2,867,917 | 1/1959 | Carlton | 35/33 UX |
| 3,363,339 | 1/1968 | Place | 35/38 |

FOREIGN PATENTS OR APPLICATIONS

| | | | |
|---|---|---|---|
| 245,966 | 8/1947 | Switzerland | 139/33 |
| 26,395 | 1/1913 | United Kingdom | 235/123 |

*Primary Examiner*—James Kee Chi
*Attorney, Agent, or Firm*—Charles B. Haverstock

[57] ABSTRACT

An apparatus for use on looms and weaving devices, and especially hand operated weaving devices or looms, which apparatus enables the operator whether sighted or a person of limited or no vision, to weave even fairly complex patterns involving frequent selections of different treadling lever settings and other operations without losing track of where he is in the weaving process, and also enables a person to easily pick up where he or she left off in a weaving operation without making a mistake and without requiring study or instruction, the improvement comprising a plurality of identifier members having instructions printed, embossed or otherwise applied thereto, one or more such identifier members being provided for each operation or each sequence of operations in a weaving process, and means for supporting a plurality of said identifiers in an orderly manner and at a location convenient to the operator so that they can be moved from an active to an inactive position as the weaving operation progresses without mixing them up or changing the order in which they are used.

14 Claims, 6 Drawing Figures

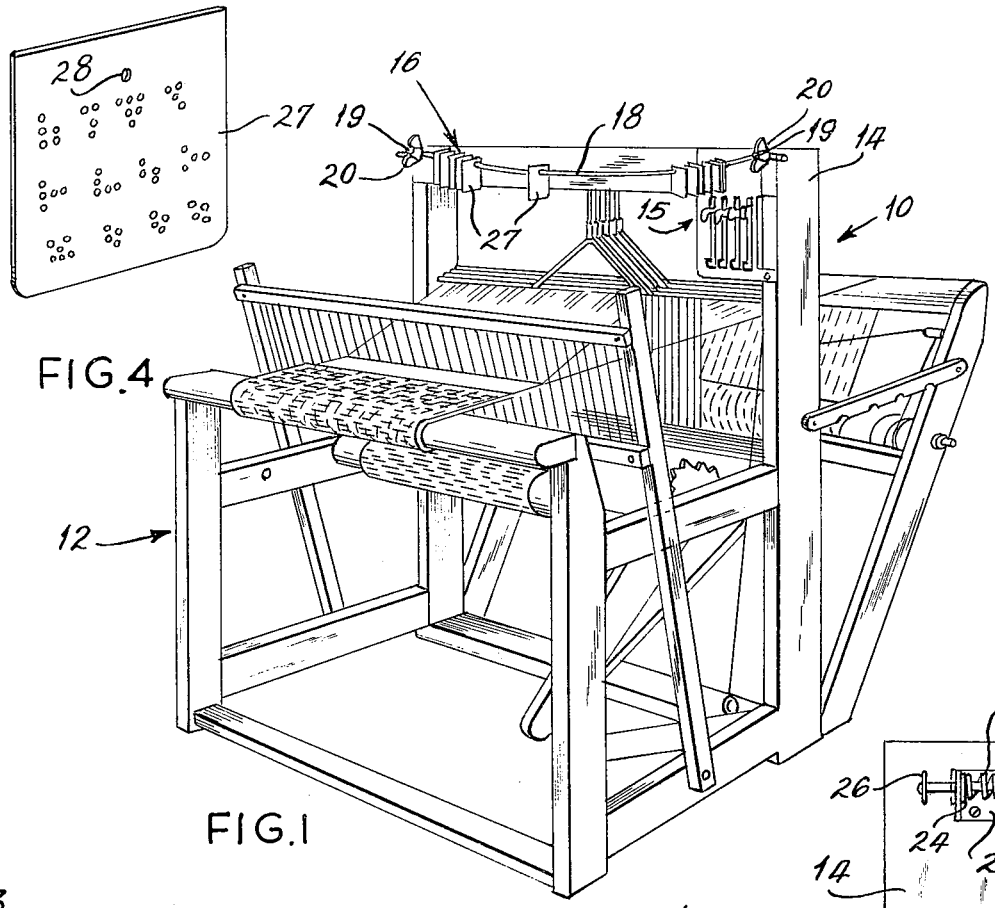
FIG.4
FIG.1
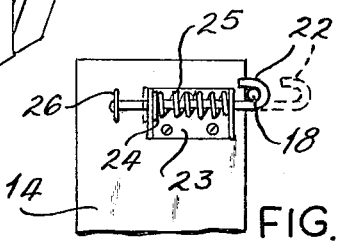
FIG.3
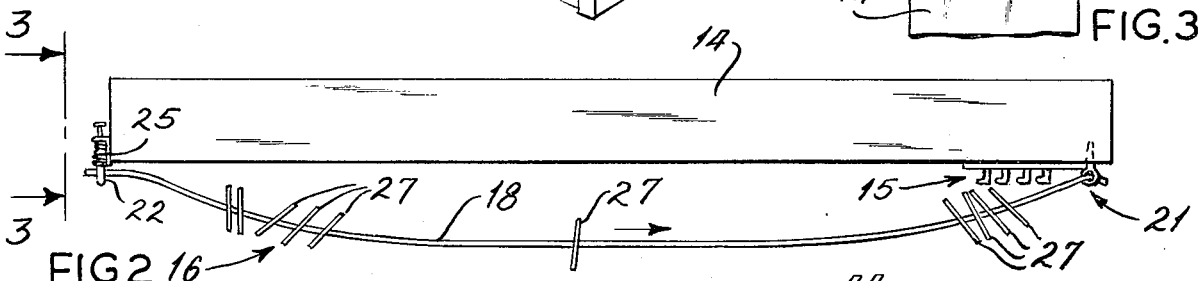
FIG.2
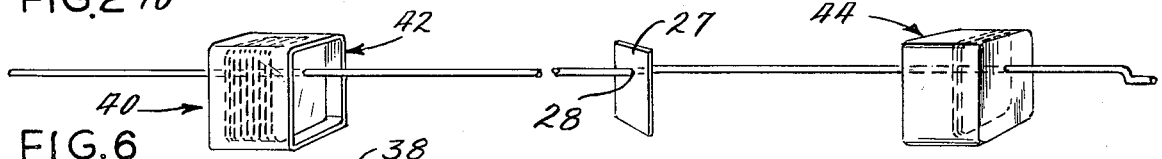
FIG.6
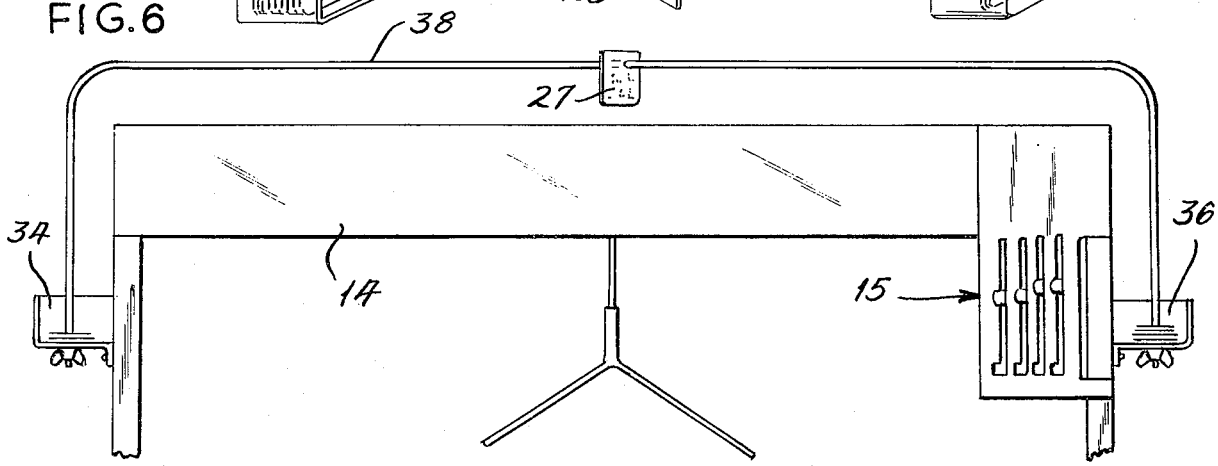
FIG.5

MEANS FOR KEEPING TRACK IN WEAVING OPERATIONS

The art of weaving dates back thousands of years, and during the course of its history many kinds of weaving devices or looms and many ways of weaving and weaving patterns and styles have been developed. In early times weaving was done on relatively simple looms usually located in a home and these were for the most part relatively crude and inefficient and incapable of being used to weave complex patterns. In more recent times, the weaving of cloth and other materials has been mechanized and the machinery involved is more complicated and often is located in factories where they are operated by relatively skilled persons on a production schedule. Even though weaving has become more mechanized there are many persons who continue to do weaving in homes and for their own pleasure, and the small operator continues to be an important factor in the weaving industry. Furthermore, weaving is an art which has appealed to persons of varying talents and capabilities including people who are sighted as well as sightless people. So far as known, however, there are no means such as the present means whereby a weaver can keep track of where he is in a weaving process except by referring to the pattern or to a book or manual of instructions all of which requires time and effort. The present means solve this problem and overcome many of the shortcomings associated therewith by enabling a weaver quickly and accurately and without referring to any outside source or books or other instructions to know at all times where he is in a weaving process and what the next step or procedure is. This includes knowing such information as the positions or settings of the treadling levers and any other instructions that may be required. It is important to be able to take up where one leaves off especially where the weaver from time to time gets away from the work and where the weaver lacks the ability to be able to restudy the pattern and refamiliarize himself with where he is in the weaving process without relying on outside help. The advantages of being able to do this for a weaver who has all of his faculties are substantial but for weavers who have some impairment such as for weavers of limited vision and sightless weavers the present means enable them to be able to continue with the weaving operation uninterrupted. The present means therefore not only save time but also enables weavers to pick up where they leave off without special help. This is very important for persons who would be stymied and would be unable to continue a weaving operation until they receive help.

It is therefore a principal object of the present invention to provide means whereby a weaver can quickly and accurately pick up where he leaves off in a weaving process without referring to instructions or requiring outside help.

Another object is to provide relatively simple and inexpensive means for keeping track in a weaving process.

Another object is to make weaving available as a vocation or avocation to a greater number of people.

Another object is to make it possible for a weaver to leave his loom from time to time without having to restudy the pattern or a set of instructions each time he returns in order to continue with the weaving.

Another object is to provide a relatively simple instruction means for use on a loom or other like device which facilitates the acccurate following of a pattern, which instruction means can be replaced by other similar sets of instruction means when weaving different patterns.

Another object is to make weaving available to persons with many different capabilities including sighted andd sightless persons.

Another object is to provide means to facilitate the teaching and learning of weaving on a loom.

Another object is to develop a library of different sets of weaving instructions.

Another object is to make it possible for persons to weave simple as well as complex patterns in an orderly and easy to follow manner.

These and other objects and advantages of the present invention will become apparent after considering the following detailed specification which covers a preferred embodiment of the subject improvement in conjunction with the accompanying drawing, wherein:

FIG. 1 is a perspective view showing a loom equipped with means constructed according to the present invention;

FIG. 2 is a top plan view showing the portion of the loom of FIG. 1 which has the subject improvement installed thereon;

FIG. 3 is a fragmentary side view showing a quick release means for attaching one end of a rod to a loom;

FIG. 4 is a perspective view of a typical instruction card for use with the subject means;

FIG. 5 is a fragmentary front view of a loom showing another embodiment of the subject means; and, FIG. 6 shows a two-piece box construction which can be filled with a plurality of instruction cards needed to perform a particular sequence of steps of a weaving operation.

Referring to the drawing more particularly by reference numbers, number 10 in FIG. 1 identifies a weaving machine or loom generally. The structural and operational details of the loom 10 may be of known construction including a loom having a frame 12 with an upright frame portion 14. The upright portion 14 is conveniently located on the loom and some of the controls for the loom such as treadling levers 15 are located on the portion 14. In addition, the upright portion 14 has provision for locating the subject improvement, and several different forms of the improvement are disclosed. The improvement includes means by which the operator can keep track of where he is in the weaving process and can quickly learn what his next step should be.

In the embodiment as shown in FIGS. 1 and 2 the subject means are generally identified by the number 16 and are shown as including a formed cord, wire or rod such as formed metal rod 18 which is anchored at its opposite ends to opposite sides of the upright frame portion 14 adjacent opposite sides of the loom. The anchoring means can be in the form of threaded members such as threaded shafts 19 and cooperating wing nuts 20, or other means can be used to attach the cord such as means 21 to hingedly connect one end and other means such as spring biased hook 22, to fasten the opposite end. The hook 22 is shown mounted in bracket 23 with collar 24 biased by spring 25 to the position shown in solid outline in FIG. 3. The hook 22 also has a button 26 which can be pressed to move the hook member 22 to the dotted position in which the free end of the rod 18 can be removed for purposes which will be explained. A plurality of instruction cards 27 which have apertures 28 through them are positioned for movement on the rod 18. The number of cards 27 needed for a particular weaving operation will depend on the complexity of the pattern being woven, the number of colors involved, the number of different settings of the treadling levers 15, and any other special instructions that are needed for the operator to accurately perform a desired weaving operation. Furthermore, it is possible that for a particular weaving operation one or more sequences of steps may be repeated several or more times in succession or at spaced intervals and if this is the case a particular set of instruction cards can be used repeatedly or intermittently as required.

It may also be desired to indicate special instructions on certain of the cards 27 including indicating the number of each card including indicating the number of each card including indicating the first and last card in each sequence or set, identifying each different set, identifying on the first and last card information as to what should have come before and what should follow, and any other pertinent information. If a particular step or group of steps are to be repeated this can be indicated and accomplished by reusing the same card or group of cards as many times as required. If different sequences are called for, care must be taken to make sure that the proper groups are used and that they are used in the proper order. The possibilities in this regard are many and varied, and the more complex the weaving process the more cards may be required and the greater the care that must be exercised. Regardless of how complex the process may be, however, the present means provide a convenient, economical, easy to use and accurate way to keep track of each sequence and each step in each sequence, and it enables the operator to leave and return to the loom without losing track of where he is in the weaving process. This becomes more important as the weaving operation increases in complexity as when the pattern, colors and treadling lever settings change frequently. Treadling levers are well known in the weaving art and the various levers control associated harnesses. A particular loom may have almost any number of treadling levers and the setting of these levers is very important to the operation.

The cards 27 can be printed cards that include all of the information that is necessary for the weaver to know, and the information on the cards can be applied in other ways as well such as being applied in Braille or in some other form of coding. The information can also be applied to one or both sides of each card. Up until this invention, pattern and other instructions for weaving whether printed or in Braille have generally been set forth in book or pamphlet form often with the instructions for many steps recorded on a single page. This has made it time consuming and confusing to pick up where one leaves off and has meant that unskilled persons and persons who are sightless or otherwise incapacitated have simply had to wait for help before proceeding. With the present means this is no longer necessary.

FIG. 5 shows an embodiment of the subject means wherein the upright portion 14 of the weaving machine or loom has pockets or compartments 34 and 36 located as shown. This construction includes a U-shaped rod 38 which is attached extending from adjacent opposite sides of the portion 14 and across the top thereof. During a weaving process, a plurality of the cards initially in the pocket 34 are taken one at a time from the top of the stack and moved upwardly along the rod 38, across the top of the loom and finally are deposited in a stack in the pocket 36. With this construction the active card can be maintained on a central horizontal portion of the rod 38 as long as necessary and in this position it is readily accessible to the weaver. Only after all the steps indicated on the card have been performed will the card be moved to the inactive pocket 36. This therefore provides the operator with a convenient way to accurately keep track of what steps have been performed and what steps still need to be performed. This can be further indicated if desired by the position of the card on the rod 38 as well as by whether the card is in one or the other of the pockets or compartments 34 and 36. This may also depend on how much information or how many instructions are to be indicated on any one card.

In FIG. 6 a plurality of the cards are shown positioned in a box or box-like structure 40. The box has inner and outer portions 42 and 44 and the box portions as well as the cards contained therein have holes which are in alignment to enable the box and the cards to be quickly installed on a rod such as the rod 38 (or 18). In this embodiment the box serves not only as a convenient storage container for the cards but it also serves as a compartment from which and to which the cards are moved during use. In order to mount the box of cards on the rod 38 it is necessary to loosen one end of the rod and thread the loosened end of the rod through the box and through the cards contained therein. After this is done, one part of the box, the part 42 with the cards in it, is located at one end of the rod 38 and at one side of the loom, and the opposite part of the box which is now empty is located at the opposite end of the rod 38 in position to receive the cards as they are used. During weaving each succeeding top card is taken from the box portion 42 and moved along the rod 38 to the opposite end thereof where they are accumulated in the box portion 44, and this will continue until all of the cards are in the box portion 44. The two box portions are now reclosed and removed from the rod 38, or the cards only can be returned to the box portion 42 if the same operation is to be repeated. One advantage of the box type arrangement is that the boxes provide a convenient way to handle and store the cards, and the boxes can be labeled or marked in the same way that the cards are marked. Also with the box arrangement it is not likely that the cards will get out of order, and boxes of cards can be accumulated to build a library of different possible sets of weaving instructions.

Instructions such as those described above can also be used in threading a loom prior to the actual weaving operation. The threading of the warp threads is especially difficult for sightless persons and for beginners. With the present means it is possible for such persons not only to prepare their looms for weaving but also to perform the entire weaving operation and without requiring the help or assistance of any other person.

Thus there has been shown and described novel means for keeping ones place in a weaving process with a minimum of outside help and without having to refer to complicated, difficult to understand instructions, which means fulfill all of the objects and advantages sought therefor. It will be apparent, however, that many changes, modifications, variations and other uses and applications of the subject means can be made and are contemplated. All such changes, modifications, variations and other uses and applications which do not depart from the spirit and scope of the invention are deemed to be covered by the invention which is limited only by the claims which follow.

What is claimed is:

1. In a weaving device such as a loom having a frame and means on the frame for mounting a plurality of treadling levers different combinations of the settings of which may be made depending upon a weaving operation to be performed, the improvement comprising means whereby an operator can determine step-by-step each operation he has to perform in a desired weaving operation so he can weave a desired pattern in a proper sequence and keep track of where he is in a weaving process, said means including an elongated guide member having opposite ends and means for attaching the opposite ends to spaced locations on the loom so that the guide member is at an easily accessible location, and a plurality of instruction cards mounted for movement along said guide member, movement of said cards being independent of other functions of the weaving device, each of said cards having an instruction formed thereon which advises the operator as to each particular step to be performed in the weaving process, said cards being movable along the guide member as the step to be performed that is indicated thereon is completed, said guide member being formed to enable accumulating a plurality of said cards adjacent opposite ends thereof.

2. In the weaving device defined in claim 1 each of said cards has an opening therethrough positioning it on the guide member, and container means located adjacent to opposite ends of the guide member for accumulating a plurality of said cards therein.

3. In the weaving device defined in claim 1 each of said cards has an instruction printed thereon

4. In the weaving device defined in claim 1 each of said cards has a weaving instruction formed thereon in Braille.

5. In the weaving device defined in claim 1 said guide member includes a formed rod having loop portions formed at the opposite ends thereof and threaded means on the weaving device engageable with the respective loop portions for attaching them thereto.

6. In the weaving device defined in claim 1 said guide member includes a formed rod having spaced opposite ends, and means on the weaving device for attaching the opposite ends of said rod to opposite sides of the weaving device whereby said rod has a central portion which is spaced from the weaving device.

7. In a weaving device such as a loom having means to perform various weaving steps, the improvement comprising instruction means including an elongated rod like member and means for fixedly attaching opposite ends thereof to the loom, one of said means fixedly attaching the rod like member being releasable, and a deck of instruction cards with instructins on each card as to the steps to be performed in a weaving operation, each of the cards in said deck having an opening therethrough, the openings in said cards being in alignment so that the released end of the rod member can be threaded through the deck of cards and thereafter reattached to the loom, said rod like member being shaped to provide room adjacent to the opposite attached ends thereof to accommodate the deck of cards, said cards being movable one at a time independently of other functions of the loom along the rod as the weaving step indicated thereon is performed.

8. In the weaving device defined in claim 7 wherein the deck of cards is positioned in a box having separable portions, said separable portions having openings therethrough in alignment with the openings through the cards in the deck so that the box can be mounted on said rod like member with the cards therein and thereafter the separable portions located adjacent to each opposite end of said rod like member.

9. In the weaving device defined in claim 7 wherein the rod like member is formed to a U-shape having spaced leg portions and a portion connected therebetween, means connecting the free ends of the spaced leg portions to spaced locations on the loom whereby the cards are initially positioned on one of the leg portions and are movable therefrom as the weaving process continues along the rod like member to the opposite leg portion where the cards are accumulated.

10. In the weaving device defined in claim 9 including means adjacent to the opposite leg portions of the formed rod like member forming pockets in which the cards can accumulate.

11. In the weaving device defined in claim 7 including threaded means for connecting the rod like member to the loom.

12. In the weaving device defined in claim 7 wherein one end of the rod like member is hingedly attached to the loom.

13. In the weaving device defined in claim 8 wherein one of said separable box portions has means thereon to identify the box and the contents thereof.

14. In the weaving device defined in claim 7 wherein each card has the instructions applied thereto in Braille.

* * * * *